United States Patent [19]

Scott

[11] 3,979,635

[45] Sept. 7, 1976

[54] CHARGED PARTICLE BEAM SCANNING DEVICE

[75] Inventor: Warner Curtis Scott, Dallas, Tex.

[73] Assignee: Texas Instruments Incorporated, Dallas, Tex.

[22] Filed: Feb. 5, 1975

[21] Appl. No.: 547,141

[52] U.S. Cl. ..... 315/12 R; 313/409

[51] Int. Cl.[2] ..... H01J 29/41

[58] Field of Search ..... 315/12 ND, 31 R, 11, 315/12, 365, 366, 31 FT; 340/324 M; 313/470–473, 409, 410, 411, 500, 510, 495

[56] References Cited

UNITED STATES PATENTS

| | | | |
|---|---|---|---|
| 3,740,603 | 6/1973 | Kuhn | 313/410 |
| 3,742,276 | 6/1973 | Gumpertz | 313/410 |
| 3,769,540 | 10/1973 | Thomson | 315/12 |
| 3,803,443 | 4/1974 | Hant | 315/12 |

*Primary Examiner*—T.H. Tubbesing
*Assistant Examiner*—T. M. Blum
*Attorney, Agent, or Firm*—Harold Levine; James T. Comfort; Richard L. Donaldson

[57] ABSTRACT

A plurality of control plates are sandwiched between a cathode and a target to control the flow of charged particles such as electrons and ions between the cathode and the target. Each control plate has a plurality of apertures formed therein which are effectively aligned with corresponding apertures on the other control plates. At least one input buffer plate and one output buffer plate are sandwiched between the control plates and the cathode and target respectively. The input buffer plate and the output buffer plate have a plurality of apertures formed therein aligned with corresponding apertures in the control plates. The aligned apertures form beam channels. The control plates have conductive electrodes thereon arranged at predetermined coded finger patterns. D.C. voltages are applied to the buffer plates to provide electron optic lensing and voltages are selectively applied to the control plate electrodes by switching circuitry to selectively open and close beam channels. The separation of the buffer plates from the control plates is by anomalously thick spacer plates to isolate the control plates from the high voltages associated with the buffer plates. By selective switching control of the control plates a beam, or a plurality of beams, can be directed to a selected portion or portions of the target at a time.

14 Claims, 8 Drawing Figures

CHARGED PARTICLE BEAM SCANNING DEVICE

This invention is directed to a charged particle beam scanning device responsive to a digital control signal and more particularly to such a device which has an improved signal control of the charged particle beam.

Another charged particle beam scanning device is disclosed in U.S. Pat. No. 3,803,443. In such a device, a plurality of control plates are sandwiched between a cathode and a target to control the flow of charged particles such as electrons and ions between the cathode and the target. Each control plate has a plurality of apertures formed therein which are effectively aligned with corresponding apertures on the other control plates. The aligned apertures form beam channels. Control plates have conductive electrodes thereon arranged in predetermined coded finger patterns. Voltages are selectively applied to the control plate electrodes by means of switching circuitry to electrostatically focus the charged particles through the apertures associated with selected electrodes while simultaneously aborting the passage of charged particles through the apertures associated with the remaining electrodes. In this manner by selective switching control of the control plates a beam or plurality of beams can be directed to a selected portion or portions of the target at a time. Such scanning devices as those described have distinct advantages over cathode ray tube scanning devices of the prior art because of their compact configuration, high linearity and capability of response to randomly addressed digital control signals.

A significant problem in such charged particle scanning devices has been the necessity of large voltage swings on the control plates (or switching plates as they are often referred to). Such voltage swings have been in the order of 50 to 140 volts. One identified problem was in the design of the cathode. A copending patent application, Ser. No. 463,934, filed Apr. 25, 1974, assigned to Texas Instruments, discloses a new cathode which is a much more efficient cathode. However, even with this new cathode higher voltage swings on the control plates are required than are desired. The lower voltage swings are desired to allow electronic drive circuitry to be used that are compatible with such low voltage swings. Such electronic drive circuitry as MOS and bipolar integrated circuits normally operate at about 20 volt swings or less. It has been found that the proximity of adjacent positive control plates is the most dominant deterrent to low voltage switching. Further low voltages produce weak electric fields which are insufficient to provide satisfactory electron focusing in these devices. According to this invention it has been discovered that to provide low voltage switching and good electron transmission and focusing, the switching stack should consist of one or more input buffer plates operated at D.C. potentials whose sole function in the stack is electron lensing, high aspect ratio closely spaced control plates relieved of any electron optical function and able therefore to operate as shutters only, and do so with low voltage swings, and one or more output buffer plates whose sole function is electron lensing only. The separation of the input buffer plates, the control plates, and the output buffer plates is by anomalously thick spacer plates whose function is to isolate the control plates from high voltages associated with the buffer plates.

It is therefore an object of this invention to provide a new and improved charged particle beam scanning device.

Another object of this invention is to provide a new and improved charged particle beam scanning device compatible with low voltage electronic drive circuitry.

It is another object of this invention to provide a new and improved charged particle scanning device operable with low voltage swings on the control plates of the device.

Figure 2:
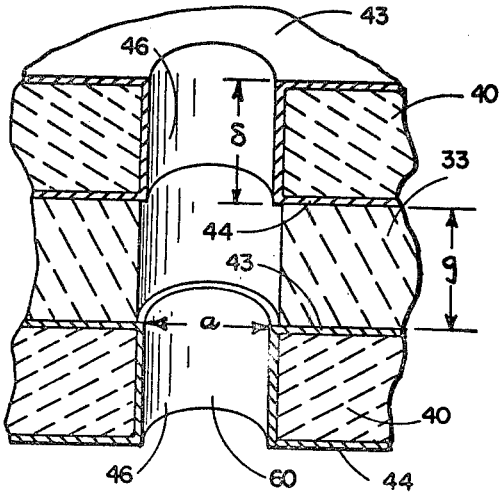
FIG. 2 is a cross-sectional view illustrating the construction of the embodiment shown in FIG. 1.
Figure 3:
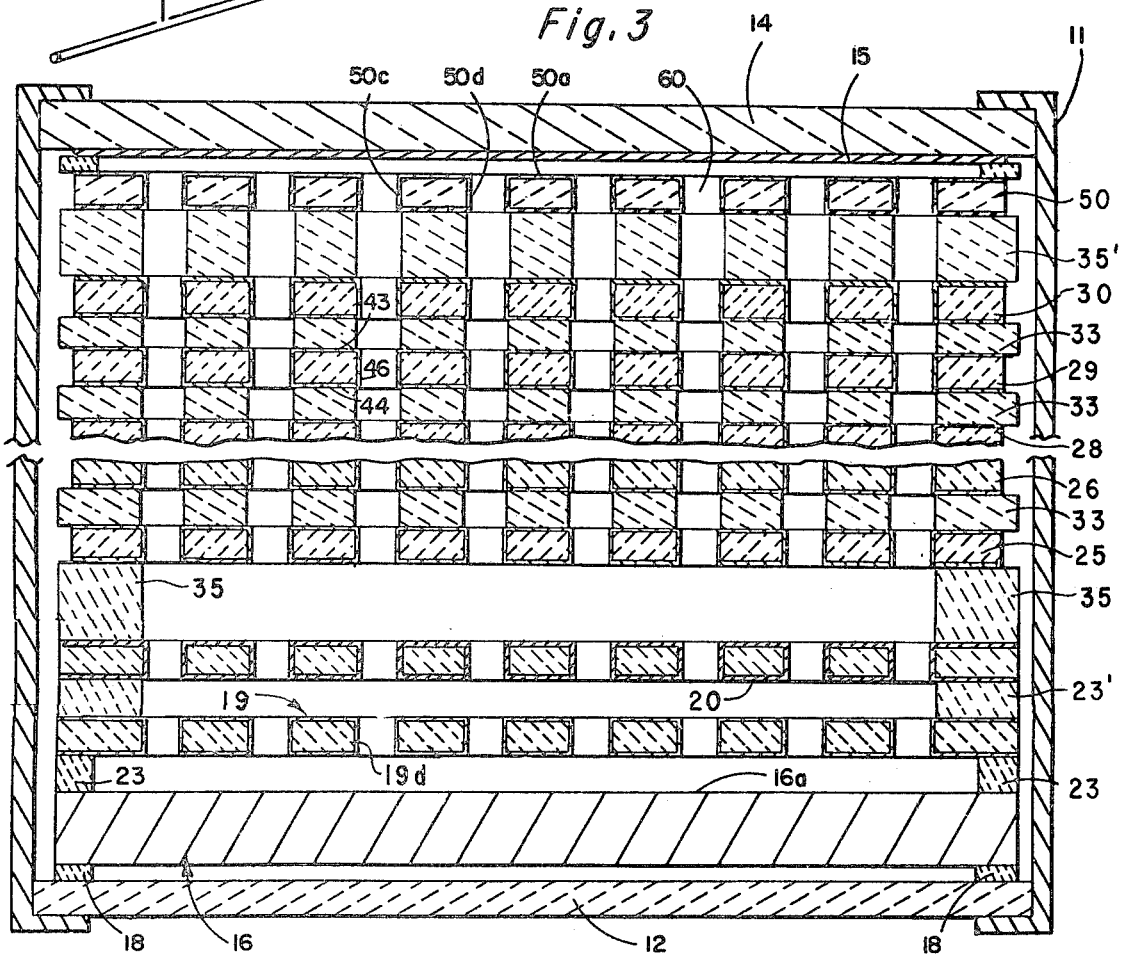
FIG. 3 is a cross-sectional view showing details of the electron beam channels of the embodiment of FIGS. 1 and 2.

Referring now to FIGS. 2 and 3, cross-sectional views illustrating the structure of one embodiment of the device of the invention are shown. It is to be noted that for illustrative purposes, an 8×8 display is shown, but that in more practical implementations, a much greater number of beam channels would be utilized to provide a much higher definition display. A vacuum tight casing is formed by means of side frame member 11, ceramic plate 12, and glass front viewing plate 14. The casing so formed is evacuated so as to provide a vacuum environment for the components contained therein.

Figure 4:
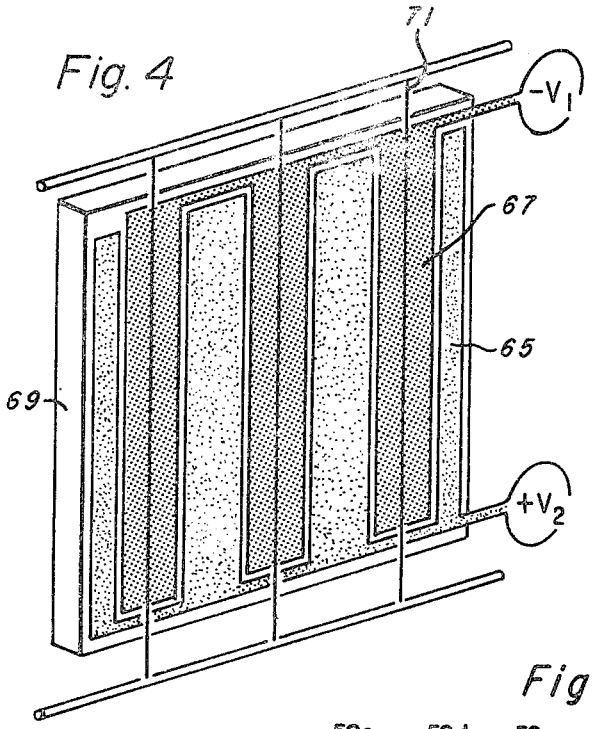
FIG. 4 shows the area cathode of the embodiment in more detail.

Cathode 16, which is shown in FIG. 4 in more detail, is supported along opposite edges thereof on bar members 18. Mounted directly opposite cathode 16 are input buffer plates 19 and 20, which are formed from solid metal such as a nickel-iron alloy. Input buffer plates 19 and 20 are separated from cathode 16 by means of insulator spacer bars 23. Input buffer plates 19 and 20 are insulatively separated by insulator spacer bars 23'.

Figure 1:
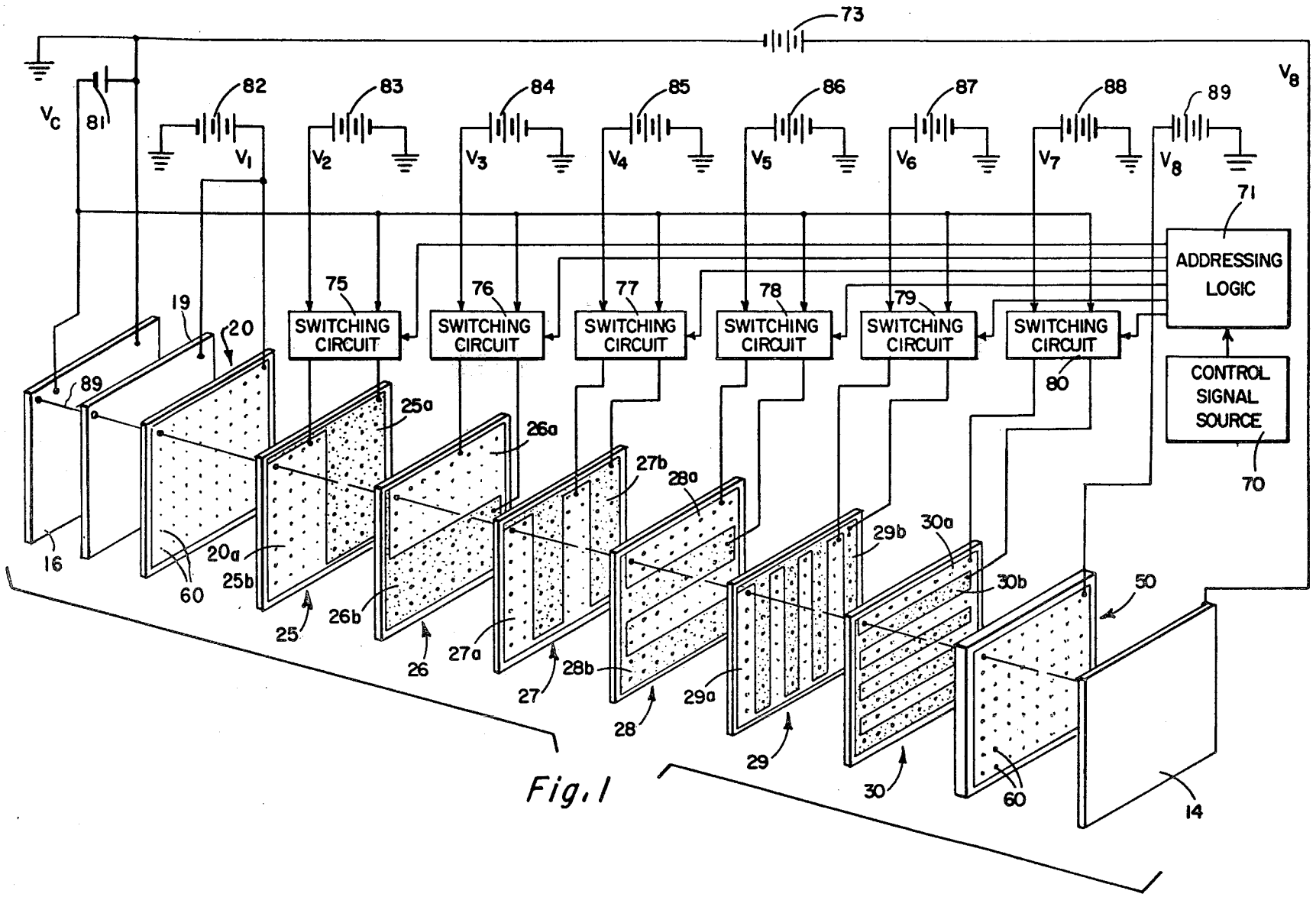
FIG. 1 is a schematic drawing of one embodiment of a charged particle beam scanning device.

Next in the stack are control or switching plates 25–30, which are insulatively separated from each other by means of insulator plates 33 which may be of a ceramic material. Plate 25 is separated from lens plate 20 by means of insulator spacer bars 35. As can best be seen in FIG. 2, the control plates are formed of a dielectric substrate 40 which may be of a material such as ceramic or glass, having similar electrodes 43 and 44 of a highly conductive material such as gold or copper deposited on the opposite surfaces thereof. The control plates may also be solid metal etched into individual perforated conductors. The electrodes are arranged in predetermined finger patterns, as illustrated in FIG. 1, with the opposite electrodes 43 and 44 of each control plate having the same finger pattern arranged opposite each other in mirror image relationship. Electrodes 43 and 44 are electrically interconnected by means of coatings 46 which are deposited on the walls of the apertures extending between the opposite sides of the plates.

Mounted above control plate 30 and separated therefrom by an insulator plate 35' is output buffer plate 50.

Output buffer plate 50 is identical in construction to input buffer plates 19 and 20.

An example of a stack architecture may have dimensions in the following ranges:

| | |
|---|---|
| control plates 25–30 | 8.52 mils |
| input buffer plates 19 and 20 | 8.52 mils |
| output buffer plate 50 | 8.52 mils |
| spacer plates 23, 23', and 33 | 5.68 mils |
| spacer plates 35 and 35' | 11.36 mils |
| hole diameter | 22.72 mils |
| hole center-to-center distances | 34.08 mils |
| stack aperture angle | 28.07 degrees |

It is important that spacer plates 35 and 35' be anomalously thicker than the other spacer plates 23, 23', and 33. This is to isolate the control plates 25–30 from the high voltages associated with the input buffers 19 and 20 and from the high voltage from the phosphor screen 15 which penetrates through the holes in output buffer 50.

Thus all electron optic lensing is performed by the buffer plates 19, 20, and 50 and isolated from the control plates 25–30, thus freeing them to operate in a drift tube mode which is the desirable mode for low voltage switching.

The low voltage control plates 25–30 are not required to perform any electron focusing, however they must be isolated sufficiently from the high lensing voltages associated with the buffer plates to perform low voltage switching.

The control plates 25–30 operate as a shutter to turn the beam on and off. In the ON state the potential field inside the hole should be positive with respect to the electrons. In the OFF state there must be a region of negative potential which completely blocks off the hole. In the switching stack however the control plates are not isolated but have neighbors, who must be expected to be on (at positive voltages) when the control plate in question must be off. The magnitude of the voltage swings necessary to shutter (turn ON or OFF) a given control plate will increase if either the magnitude or the proximity of a nearby positive potential increases. However, high voltages are required for good electron transmission and these are provided in this invention by high voltages on the input and output buffers.

All of the various plates just described have a plurality of apertures 60 formed therein, corresponding apertures of successive plates being aligned with each other to form electron beam channels between cathode 16 and phosphor target 15 on plate 14.

The two input buffer plates 19 and 20 and output buffer plate 50 are essential for good electron transmission.

Buffer plates 19, 20, and 50 have D.C. voltages applied thereto optimized to produce good spot focusing on the target 14. The voltages are in the range of +25 to +75 volts D.C. Input buffer plate 19 for example could have +32 volts D.C., input buffer plate 20 could have +64 volts D.C., and output buffer plate could have +32 volts D.C.

These high voltages increase throughput, negate charging problems associated with secondary emission, and provide appropriate electron optics for good spot focus.

Referring now to FIG. 1, the device of the invention is schematically illustrated for coated dielectric switching plates. Each of control plates 25–30 has a pair of electrodes 25*a*, 25*b* – 30*a*, 30*b*, on each of the opposite surfaces thereof. Thus, the electrodes on the opposite surfaces which are not shown are mirror images of the electrodes which are shown in the FIGURE. The electrodes are of a highly conductive material such as gold or copper. Alternatively they could be metal with etched geometry.

For the geometry shown the voltage swing applied to control plates 25–30 is 20 volts with a −11 volts applied to a control plate to turn the flow of electrons off through the holes in that portion of the control plate having a −11 volts applied thereto and a +9 volts applied to the control plates to turn that control plate on and allow electron flow through the holes in a manner to be described.

Referring now to FIG. 1, the device of the invention is schematically illustrated. Each of control plates 25–30 has a pair of electrodes 25*a*, 25*b* – 30*a*, 30*b*, on each of the opposite surfaces thereof. Thus, the electrodes on the opposite surfaces which are not shown are mirror images of the electrodes which are shown in the FIGURE. The electrodes are of a highly conductive material such as gold or copper, and each electrode 25*a* – 30*a* is electrically insulated from its paired electrode 25*b* – 30*b* respectively. As already explained in connection with FIGS. 2 and 3, the electrodes on opposite surfaces are electrically interconnected with each other by means of conductive coatings which may be of the same material as the electrodes on the walls of the apertures extending therebetween.

Digital control signals are fed from control signals source 70 to addressing logic 71 which provides an appropriate control signal to each of switching circuits 75–80. Switching circuits 75–80 may be electronic switching circuits such as flip flops, capable of alternatively connecting the voltages fed thereto to either one or the other of the paired electrodes of the particular control plate associated therewith in response to the addressing logic. Voltages are applied to switching circuits 75–80 for use in controlling the electrodes from power sources 83–88 respectively. A beam accelerating voltage is applied between cathode 16 and target 14 from voltage source 73. Switching circuits 75–80 receive first voltages $V_2$–$V_7$ from power sources 83–88 respectively, which are positive voltage with respect to ground, and a second voltage, $V_c$, which is a negative voltage with respect to ground. In this specific example $V_c$ is −11V and $V_2$–$V_7$ is +9V.

The switching circuits in response to addressing logic 71 alternatively connect $V_2$–$V_7$ as the case may be, to one of the paired electrodes of each control plate and $V_c$ to the other paired electrode. For illustrative purposes, all of the electrodes receiving the voltage $V_c$ are shown stippled, while those receiving $V_2$–$V_7$ are shown without stippling. Under such conditions a beam of electrons as indicated by line 89 will pass through only a single channel formed by the plate apertures, the flow of electrons being blocked through all other channels by virtue of the effect of a cut-off voltage $V_c$, appearing somewhere in each of these other channels.

Thus, by selective switching control of plates 25–30, the electron beam can be controlled so that it excites a single elemental portion of target 14 at a time. The control is effected by virtue of the electrostatic shuttering, achieved by means of the electron shutters formed between electrode portions of successive plates having the potentials $V_2$–$V_7$ applied thereto. The channels associated with the electrodes having the voltage $V_c$ applied thereto are cut off, the electrons being repelled in these channels and drawn off by the electrodes.

The target 14 is scanned according to the application for which the tube is used. The scanning is called out by the control signal source 70 signals to the addressing logic 71 selecting the switching plates 25–30 to control the electron beam according to the desired scanning desired.

For instance, the scanning for TV applications may be left to right and from the top to bottom of the target 14.

The electron emission from the cathode can be controlled according to the scanning of the cup negative electrodes 67. This controlled emission from the cathode 16 is described more fully with the description of cathode 16.

Input buffer plates 19 and 20 operate as electron optical elements and with the high voltages or input buffer plates 19 and 20 important in electron transmission. They are generally similar in construction to control plates 25–30, except that they are constructed from solid metal. A +32 voltage D.C. is applied to the input buffer plate 19 with +64 volts D.C. applied to input buffer plate 20 for example. Output buffer plate 50 is generally similar in construction to control plates 25–30 except made of solid metal with +32 volts D.C. applied thereto from power source 89.

It is to be noted that while the device of the invention has been described in connection with the control of an electron beam, it can be utilized to equal advantage in the control of beams formed from other types of charged particles such as positive or negative ions.

The area cathode 16 is shown in more detail in FIG. 4. Two interdigitated electrodes 65 and 67 are formed on the back plate 69. Electrode 67 is connected to a negative potential and electrode 65 is connected to a positive potential. A plurality of filament wires 71 are suspended in front of the area cathode 16 with each filament wire 71 positioned in front of the electrode 67 having a negative potential. The filament wires 71 are connected to a ground potential power source to heat the filament wires 71 to cause emission of electrons therefrom. Electrodes 65 and 67 may be evaporated directly on the back-plate 69, and insulated from each other.

When the filament wires are heated electrons are emitted towards the lens plate 20. The electrons are uniformly emitted with sufficient current density towards the lens plate to provide good brightness.

In FIG. 4 only 3 filament wires are shown. The area cathode actually has a plurality of filament wires, with each filament wire positioned in front one finger of electrode 67.

The forward and sideways electric fields from the electrodes 65 and 67 in the vicinity of the filament wires 71 achieves a forward and spreading set of electron trajectories from the filament wires.

There is little or no electron emission in the backward direction toward the plate 69 so that the power required for the area cathode is reduced. There is sufficient uniformity of current density of the emitted electrons to allow the distance from the filament wires to the lens plate to be small. This also reduces required cathode power. There is also sufficient forward current density at the first switching plate 25 so that the potential applied to that switching plate 25 may be relatively small as contrasted with previous designs.

The area cathode 16 is broadly an area source of charged particles. The charged particles may be other than electrons such as positive or negative ions. When charged particles other than electrons are emitted, an elongated source of such particles should be used instead of the filament wires.

Figure 5:
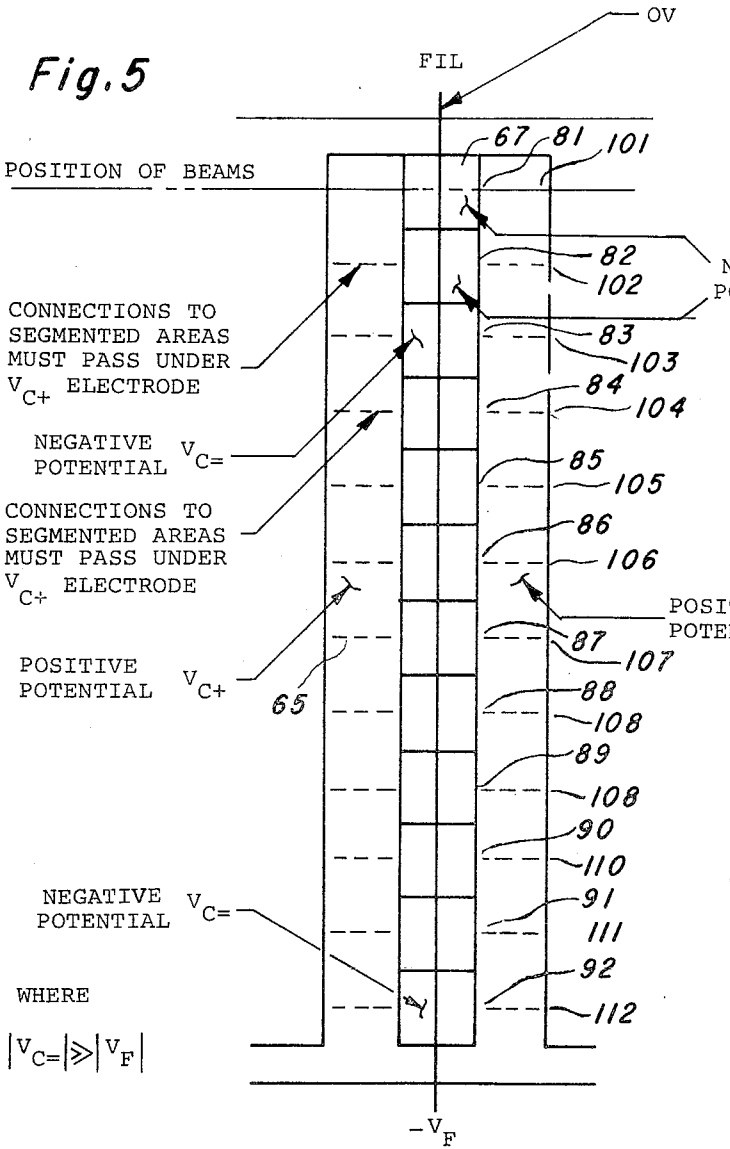
FIG. 5 shows the cathode electrodes in more detail.

Each finger of electrode 67 connected to a negative potential is segmented into a number of segments 81–92 electrically insulated from each other as shown in FIG. 5. The filament wire 71 is suspended in front of the electrode 67 and connected to a power source. Thus the interconnected segments 81–92 run perpendicular to the filament wires 71. The corresponding segments of each finger of electrode 67 are connected together in series with interconnections 101–112 passing under the fingers of electrode 65.

Figure 6:
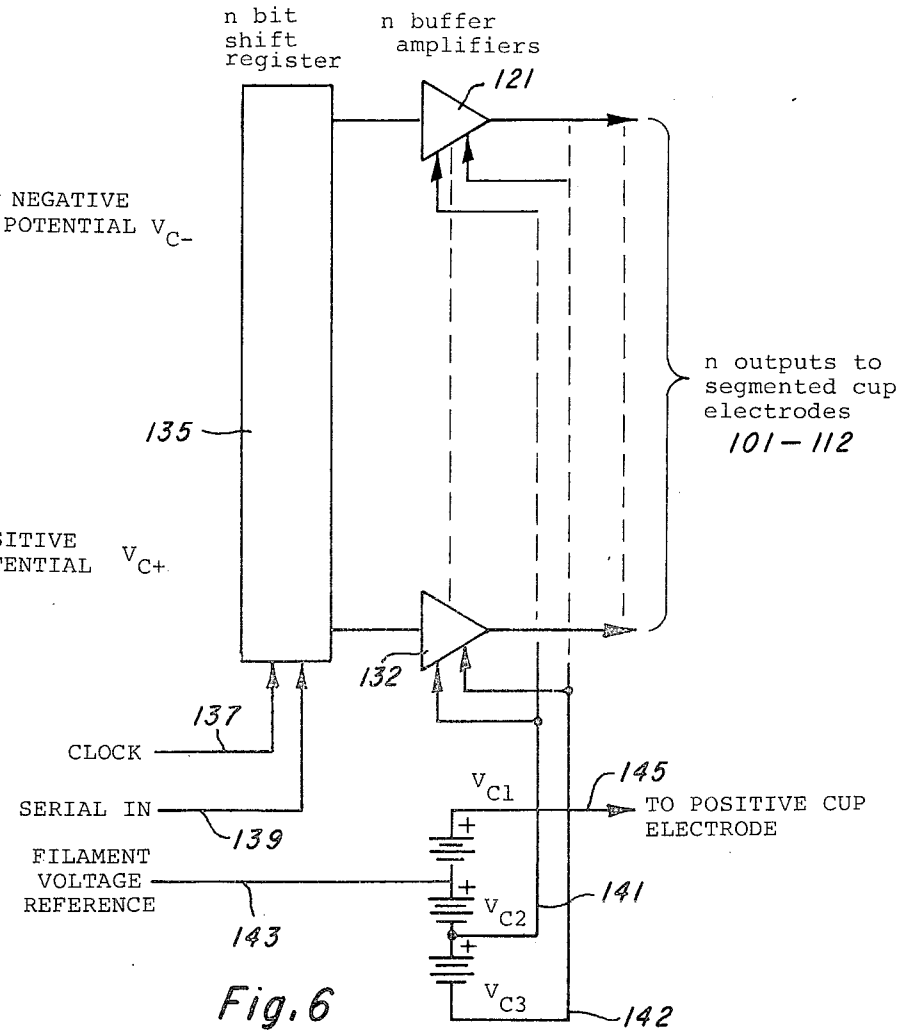
FIG. 6 shows the control circuitry for the cathode electrodes.

The interconnections 101–112 are fed out of the envelope and are connected to cathode logic shown in FIG. 6. The interconnections 101–112 are connected to a plurality of buffer amplifiers 121–132, with each interconnection 101–112 connected to a buffer amplifier 121–132. In FIG. 6 only buffer amplifiers 121 and 132 are shown with the others represented by a dotted line. Each buffer amplifier 121–132 has an enabling input connected to one stage of a twelve stage shift register 135. The shift register 135 has a first clock input 137 and a serial frame input 139. These inputs 137 and 139 are from control signal source as shown in FIG. 1. Each buffer amplifier 121–132 is connected to the negative first potential $V_{C2}$ 141 and a second negative potential $V_{C3}$ 142. The first and second voltage potentials 141 and 142 are both negative with respect to the filament voltage reference 143 and the positive voltage potential $V_{C1}$ 145 supplied to the positive cathode electrode 65.

Figure 7:
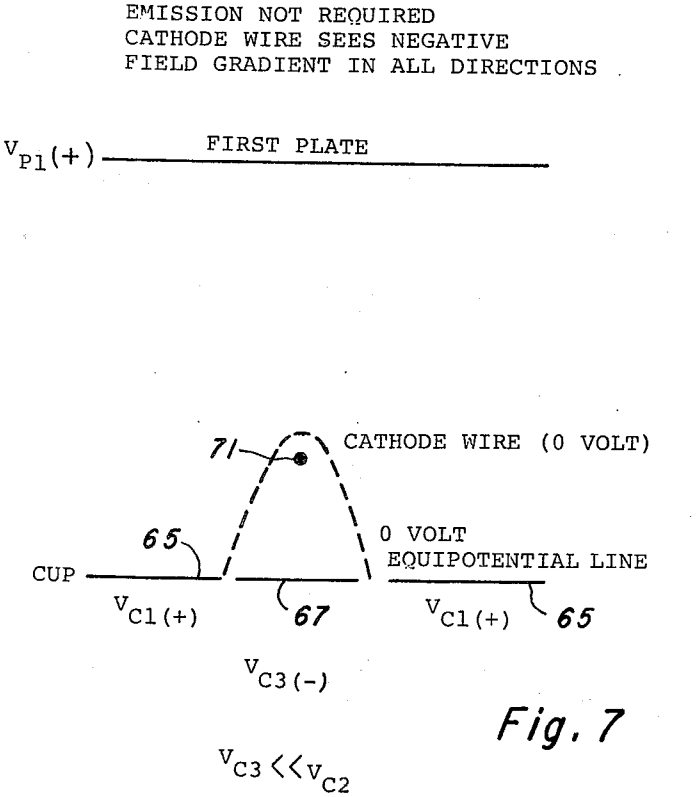
FIG. 7 and FIG. 8 show the effect on emission from the cathode of the potentials applied to the segments of the negative electrode of cathode.
Figure 8:
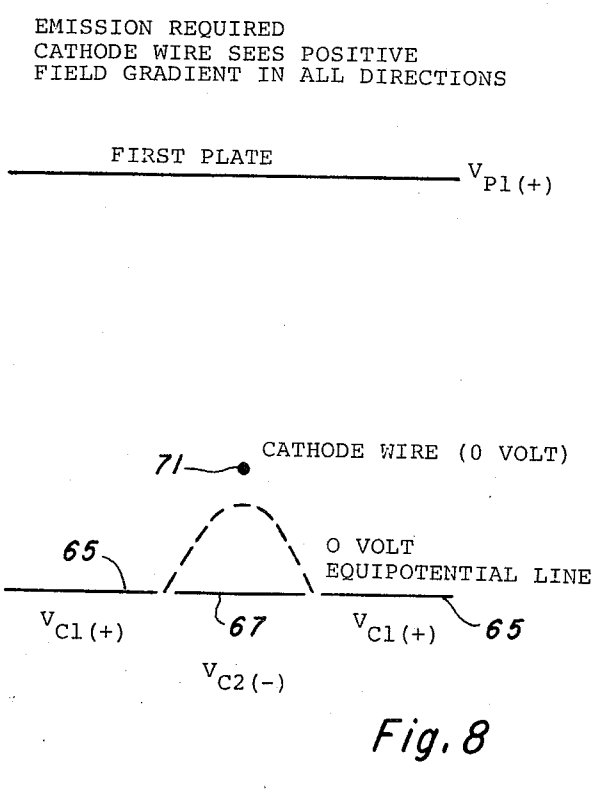

The buffer amplifiers 121–132 normally apply negative potential $V_{C3}$ to each segment 81–92 of the negative electrode 67. The application of negative potential $V_{C3}$ to a segment 101–112 cuts off emission from that portion of the filament wire 71 as shown in FIG. 7. The application of negative potential $V_{C2}$ as shown in FIG. 8 causing emission from filament wire 71.

When frame input signal is shifted into a shift register stage in shift register 135, the corresponding buffer amplifier 121–132 is enabled to apply negative potential $V_{C2}$ to be applied to the corresponding segment 101–112 instead of negative potential $V_{C3}$, causing emission from the filament wire 71 in front of that segment. Normally two or more of the segments 101–112 have negative potential $V_{C2}$ applied at the same time.

In operation of the cathode 16, as the target it is scanned by the electron beam, scanning signal are applied on terminal 139 to the shift register 135. For instance, if the scanning is from the top to the bottom of target 14, the scanning signals applied to shift register 135 are shifted first into the two stages of the shift register 135 corresponding to segments 81 and 82, applying negative potential $V_{C2}$ to segments 81 and 82, causing electron emission from the filament wires 71 in front of segments 81 and 82 of interdigited electrode 67. The electron emission then passes through the selectively switched control plates 25–30 to excite the selected portion of the target 14. As the target 14 is scanned from the top down the scanning signal is shifted down the stages of the shift register 135 apply negative potential $V_{C2}$ to the segments where emission is desired and apply negative potential $V_{C3}$ to the segments where no emission is desired as shown in FIGS. 7 and 8.

This allows a solid metal buffer plate 20 to be used allowing better terminal conditions of heat to the ambient. Also since the switched electrodes never collect any current and have low capacities MOS drive circuitry can be used.

What is claimed is:

1. A charged particle beam scanning device comprising:

a source of charged particles, an area target, at least one input buffer plate, a plurality of control plates, and at least one output buffer plate, said input buffer plate, said control plates, and said output buffer plate sandwiched between said source and said target, each of said control plates and buffer plates having a plurality of apertures formed therein, corresponding apertures of said control plates being aligned to form beam channels between the source and the target, said control plates each having a plurality of electrodes on at least one of the surfaces thereof, said electrodes on each of said surfaces being electrically insulated from each other, a plurality of first spacer means having a predetermined thickness sandwiched between said control plates electrically isolating said control plates, second spacer means anomalously thicker than said first spacer means sandwiched between said first and second buffer plates and said control plates electrically isolating said first and second buffer plates from said control plates, means for providing positive D.C. potentials to said buffer plates providing lensing of said charged particles from said source to said target, and means for selectively providing potentials to the electrodes on said control plates to selectively direct said charged particles to said target.

2. The charged particle beam scanning device claimed in claim 1 wherein said source is an area cathode for generating electrons.

3. The charged particle beam scanning device claimed in claim 1 including means for selectively applying positive potentials to the electrodes on said control plates to direct at least one beam of electrons to a selected portion of said target and for selectively applying negative potentials to the electrodes on said control plates to stop transmission of beams of electrons.

4. The charged particle beam scanning device claimed in claim 1 wherein said second spacer means are approximately twice the thickness of said first spacer means.

5. An electron beam scanning device comprising:

an electron flood gun for providing a uniform flow of electrons over a predetermined area, said electron flood gun including a flat plate, a first electrode having a negative potential on said flat plate, a plurality of elongated filaments for generating electrons positioned in front of said first electrode, and a second electrode having a positive potential on said flat dish interdigitated with said second electrode, an area target, at least one input buffer plate, a plurality of control plates, and at least one output buffer plate, said input buffer plate, said control plates, and said output buffer plate sandwiched between said electron flood gun and said target, each of said control plates and buffer plates having a plurality of apertures formed therein, corresponding apertures of said control plates being aligned to form beam channels between the source and the target, said control plates each having a plurality of electrodes on at least one of the surfaces thereof, said electrodes on each of said surfaces being electrically insulated from each other, a plurality of first spacer means having a predetermined thickness sandwiched between said control plates electrically isolating said control plates, second spacer means anomalously thicker than said first spacer means sandwiched between said first and second buffer plates and said control plates electrically isolating said first and second buffer plates from said control plates, means for providing positive D.C. potentials to said buffer plates providing lensing of said electrons from said electron flood gun to said target, and means for selectively providing potentials to the electrodes on said control plates to selectively direct said electrons to said target.

6. An electron beam scanning device comprising:

an electron flood gun for providing a uniform flow of electrons over a predetermined area, said electron flood gun including a flat plate, a first electrode positioned on said flat plate, said first electrode formed in a series of elongated parallel fingers, a second electrode positioned on said flat plate insulated from said first electrode, said second electrode formed in a series of parallel fingers interdigitated with said first electrode, a plurality of elongated filaments for generating electrons, positioned in front of each finger of said first electrode, means for applying a negative potential of each of the fingers of said first electrode and a positive potential each finger of said second electrode, an area target, at least one input buffer plate, a plurality of control plates, and at least one output buffer plate, said input buffer plate, said control plates, and said output buffer plate sandwiched between said source and said target, each of said control plates and buffer plates having a plurality of apertures formed therein, corresponding apertures of said control plates being aligned to form beam channels between the electron flood gun and the target, said control plates each having a plurality of electrodes on at least one of the surfaces thereof, said electrodes on each of said surfaces being electrically insulated from each other, a plurality of first spacer means having a predetermined thickness sandwiched between said control plates electrically isolating said control plates, second spacer means anomalously thicker than said first spacer means sandwiched between said first and second buffer plates and said control plates electrically isolating said first and second buffer plates from said control plates, means for providing positive D.C. potentials to said buffer plates providing lensing of said electrons from said electron flood gun to said target, and means for selectively providing potentials to the electrodes on said control plates to selectively direct said electrons to said target.

7. An electron beam scanning device comprising:

an electron flood gun for providing a uniform flow of electrons over a predetermined area, said flow gun including elongated electron generating means for generating electrons, a first electrode having a negative potential positioned behind said generating means, and a second electrode having a positive potential interdigitated with said first electrode, said first electrode divided into a plurality of segments, an area target, at least one input buffer plate, a plurality of control plates, and at least one output buffer plate, said input buffer plate, said control plates, and said output buffer plate sandwiched between said source and said target, each of said control plates and buffer plates having a plurality of apertures formed therein, corresponding apertures of said control plates being aligned to form beam channels between the source and the target, said control plates each having a plurality of electrodes on at least one of the surfaces thereof, said electrodes on each of said surfaces being electrically insulated from each other, a plurality of first spacer means being a predetermined thickness sandwiched between said control plates electrically isolating said control plates, second spacer means anomalously thicker than said first spacer means sandwiched between said first and second buffer plates and said control plates electrically isolating said first and second buffer plates from said control plates, means for providing positive D.C. potentials to said buffer plates providing lensing of said electrons from said electron flood gun to said target, and means for selectively providing potentials to the electrodes on said control plates to selectively direct said electrons to said target.

8. The electron beam scanning device claimed in claim 7 wherein said elongated electron generating means in said flood gun is an elongated filament.

9. The electron beam scanning device claimed in claim 8 wherein said electron flood gun includes a flat plate on which said first and second interdigitated electrodes are positioned.

10. The electron beam scanning device claimed in claim 9 wherein the filament means in the electron flood gun includes a plurality of filament wires.

11. The charged particle beam scanning device claimed in claim 10 including a power source connected to said filament means for generating electrons from said flood gun.

12. The electron beam scanning device claimed in claim 10 wherein said electrodes are arranged in a binary coded finger pattern.

13. The electron beam scanning device claimed in claim 12 wherein each finger of said first electrode is divided into a plurality of segment insulated from each other and means are provided for interconnecting corresponding segments of each finger perpendicular to said filament wires.

14. The electron beam scanning device claimed in claim 13 including means for normally providing a first negative potential to said interconnected segments of said first electrode to cut off emission from that portion of the filament in front of that segment having said first negative potential applied thereto, and for selectively providing a second negative potential to said interconnected segment to cause emission from that portion of the filament in front of that segment having said second negative potential applied thereto.

* * * * *